United States Patent [19]

Paurat

[11] 4,095,845

[45] Jun. 20, 1978

[54] METHOD OF AND APPARATUS FOR THE MINING OF COAL

[76] Inventor: Friedrich-Wilhelm Paurat, Alte Hunxer Str. 45, Friedrichsfeld, Germany, 4222

[21] Appl. No.: 708,081

[22] Filed: Jul. 23, 1976

[30] Foreign Application Priority Data

Jul. 26, 1975 Germany ..... 2533518

[51] Int. Cl.[2] ..... E21C 25/68; E21C 25/06

[52] U.S. Cl. ..... 299/18; 299/31; 299/46

[58] Field of Search ..... 299/18, 46, 53, 10, 299/67, 68, 45, 394, 31

[56] References Cited

U.S. PATENT DOCUMENTS 3,445,139 5/1969 von Hippel ..... 299/87

3,524,680 8/1970 White ..... 299/31

3,640,580 2/1972 White ..... 299/18

FOREIGN PATENT DOCUMENTS 282,232 1/1971 U.S.S.R. ..... 299/68

*Primary Examiner*—Ernest R. Purser

*Assistant Examiner*—William F. Pate, III

*Attorney, Agent, or Firm*—Karl F. Ross

[57] ABSTRACT

An excavating mining and conveying apparatus is formed of trough segments or sections with screw sections mounted on the trough sections carrying out the mining and conveying functions. Actuating means are provided to bring the screws successively into inclined contact with the face or seam of coal at an angle of from 5° to 50°. A drive is provided to transmit a torque to drive the conveying and transporting screws.

9 Claims, 7 Drawing Figures

METHOD OF AND APPARATUS FOR THE MINING OF COAL

FIELD OF THE INVENTION

The present invention relates to a method and apparatus for excavating mining and conveying. More particularly this invention relates to a method an apparatus for excavating and mining of materials such as coal along the face or wall of a body or seam of coal.

BACKGROUND OF THE INVENTION

It is known to mine by excavation using a screw type excavator which can cut arcuate or cylindrical cross-sectional excavations into the material to be mined, e.g. coal. In a known device, according to German Pat. No. 1,283,177, screw sections of a screw type excavator are all moved together with corresponding trough sections in a rigid fashion, e.g. ramlike fashion, against the wall of coal forming the face of a seam for excavation mining.

The device moves as a unit in an uninterrupted front, orthogonally towards and into the wall or face of coal so that the entire length of the screw assembly must be effective to bite into the face. Accordingly, a high torque must be transmitted to the screw shaft and the overall power requirements for mining of coal according to this method are high.

Where very long coal walls are to be mined, screw excavating and conveying apparatus of the prior art type cannot be economically employed because of the high power requirements. These problems are also not completely overcome when the excavator is advanced with the aid of a special skid mounting or sled device, as a unit to and fro and additionally parallel along the wall of the body of coal, since any savings in torque transmitted to the screw shaft is offset by additional power consumed in the back-and-forth movement of the screw of the screw excavator.

In general, the screw is employed for excavating of material to be mined and for the conveying of the excavated or mined material aong a longitudinal axis, parallel to the screw shaft, to a suitable collection point.

OBJECTS OF THE INVENTION

It is therefore an object of the present invention to provide an improved excavating mining and conveying apparatus.

Another object is the provision of an excavating mining and conveying apparatus which overcomes the above-mentioned disadvantages with high power economy.

Yet another object is to provide an excavating mining and conveying apparatus which can be utilized with good production rates in mining where conventional apparatus are relatively useless or of limited economical value.

Still another object is to provide a method for mining and excavating of coal which makes use of the mining and conveying apparatus.

SUMMARY OF THE INVENTION

The above objects are attained according to the present invention by an apparatus comprising trough segments or sections which carry screw sections. The trough sections and their respective screw sections are each joined or coupled by suitable joints or couplings to form a continuous excavating and conveying assembly.

This assembly is moved into an inclined or mining position by an actuating means which is attached to a reinforcing plate. The reinforcing plate serves as reinforcement for joining of a segment plate and a bottom plate which three latter elements are the units of a trough section. The mining or excavating is carried out by teeth mounted on the flights or threads of the screws, which flights are, in turn, mounted on the screw shaft of a screw.

In accordance with another feature of the present invention, the assembly can be equipped with further screws which permits the mining of coal from different heights with respect to the trough sections.

In accordance with yet another feature, screws can be arranged movably in height with respect to the trough sections in order to excavate coal over the entire thickness of the vein or seam of coal whereby the screws are mounted on a pivotable double arm lever, the free end of which may be actuated to cause movement of the other end carrying the excavating screw mounted thereon to various different heights.

In accordance with another feature of the invention, the couplings or joints for the formation of the continuous assembly permits longitudinal movement between coupled segments and can permit movement into a sloping or mining position with respect to the wall or face of coal to be mined. The angle of the incline or mining position may be in the range of from 5° to 50°.

More particularly this invention relates to a method for the mining of coal with the aid of an excavating apparatus of a particular kind, namely, with the aid of a screw excavating and conveying appartus working along the face of a coal seam or front, which apparatus possesses flexibly joined screw segments or sections. The segments are combined with trough segments or sections and the whole assembly is movable against the body of coal with actuating devices which actuating devices are attached to existing and/or auxiliary supporting frames or supporting devices within the excavated chamber.

The invention also deals with a particular screw excavating and conveying apparatus of the type just described which consists of a conveying screw having a shaft and flight or flights, which conveying screw is comprised of screw sections, corresponding in length to the length of the trough sections. The screw sections are journaled to the trough sections and movable with the trough sections, whereby the trough sections comprise a bottom sheet metal or plate and a segment plate which latter plate protects or covers the screw towards the excavated portion of the mine say, a stope or drift or crosscut. The bottom plate and segment plate are joined by reinforcing elements and the effective mining tools are arranged at the outermost edge of the screw flight in the form of screw excavating tools. A drive, preferably located in the crosscut and/or in the stope, transmits a torque to the screw shaft and the recovery tools will produce a segment cross-section in the face or front of coal which is complemented by the bottom plate and segment plate to form a conveying channel.

In the screw excavating and conveying apparatus of the type just described the trough is not formed below the screw sections but, more or less, parallel to the sides of the screws. Accordingly, the meaning of the word trough is used in a general sense. The actuating devices are in general cylinder arrangements which are hydraulically actuated.

By comparison with the mining apparatus of the prior-art type described above, in which the screw sections are all moved together with the corresponding trough sections against the wall of coal, the successive segments of the screw are each advanced at an incline to bite into the wall individually. Thus a lower torque can be applied to the screw shaft and the overall power requirements for the mining of coal are reduced. The system is effective even where long coal walls are to be mined.

The screw excavating and conveying apparatus of the invention has substantially reduced energy requirements thus permitting the use of correspondingly smaller drives and, accordingly, makes it possible to utilize screw excavating and conveying apparatus for mining coal from very long walls.

Thus, consecutively, along the wall of coal and in reverse, screw sections with their respective trough sections are inclinedly moved against the wall so that an angle of from 5° to 50°, preferably of from 10° to 25° is formed (when seen in a projection on the horizontal or in plan view) whereby effective mining or excavating is carried out, while the remaining screw sections with their respective trough sections are merely held in their position, generally parallel to the face of the wall of coal and thus perform only their conveying function.

According to the invention the screw sections of the screw excavating and conveying apparatus serve to carry out different functions. One or several sections are held in inclined positions and carry out mining and while in the sloping position while the others practically carry out a conveying function only. It follows, that the torque can be adjusted as the effective mining requires it, since the conveying function itself requires a substantially lower torque.

Thus during mining, the screw section or sections effectively undulate back and forth along the wall of the coal. Depending on the degree of the slope with which the effective mining function performing screw segments are pressed against the wall, the effective mining or excavating can be adjusted and can be geared to take into account different situations.

A preferred embodiment of the method according to the present invention is characterized in that the angle of the slope is varied from 10° to 25° in accordance with the desired production rate.

The production rate is also adjusted by either using in the sequence only one screw segment in sloping or excavating position or, in accordance with another feature of the invention, by using simultaneously two or more screw segments in inclined or excavating position. When in a screw excavating and conveying apparatus, which is adapted for the method according to the present invention, the screw sections and trough sections are joined telescopically, the entire screw excavating and conveying apparatus does not substantially change its parallel position relative to the coal wall during the mining operation.

The method in accordance with the present invention may be carried out, however, also in such a manner that, in accordance with the incline of a single screw section or the slope of several individual screw sections, the screw excavating and conveying apparatus is moved at the same time as a unit in inclined position. When this is done, of course, the screw sections and trough sections are joined flexibly but not telescopically.

It is within the scope of the invention to further subdivide the screw sections as well as the trough sections in order that the sections can be moved without difficulty in underground mining.

The screw flights and trough segments can overlap, e.g. as in a roof shingle overlap, so that a continuous operation of the mining and conveying functions is not hampered by separation of the screw excavating and conveying apparatus into separate screw segments and trough segments.

According to a preferred embodiment of the invention the method is carried out with screw segments having a diameter which amounts only to a fraction of the thickness of the vein or bed of coal and which may be adjusted in height over the range in which the screw segments are held in sloping or mining position which height may be adjusted with respect to the trough sections. Accordingly, without constraint or jamming, the entire height of the vein of coal may be mined even where the vein exhibits irregularities and faulting.

The advantages achieved by the invention, in comparison to known endeavors to mine coal, in which the effective mining is greatly reduced, resides in the increased rate of effective mining which is easily controlled and easily adapted to suit different situations. Of primary importance is the fact that the apparatus for carrying out the method of the invention is of relative simple construction, which results in safe and continuous operation and utilization of known and proven subassemblies. The moving devices of the present invention are known in the art and may be, for example, hydraulic cylinder arrangements.

DESCRIPTION OF THE DRAWING

The above and other objects, features and advantages will become apparent from the following description, reference being made to the accompanying drawing in which.

SPECIFIC DESCRIPTION

Figure 1:
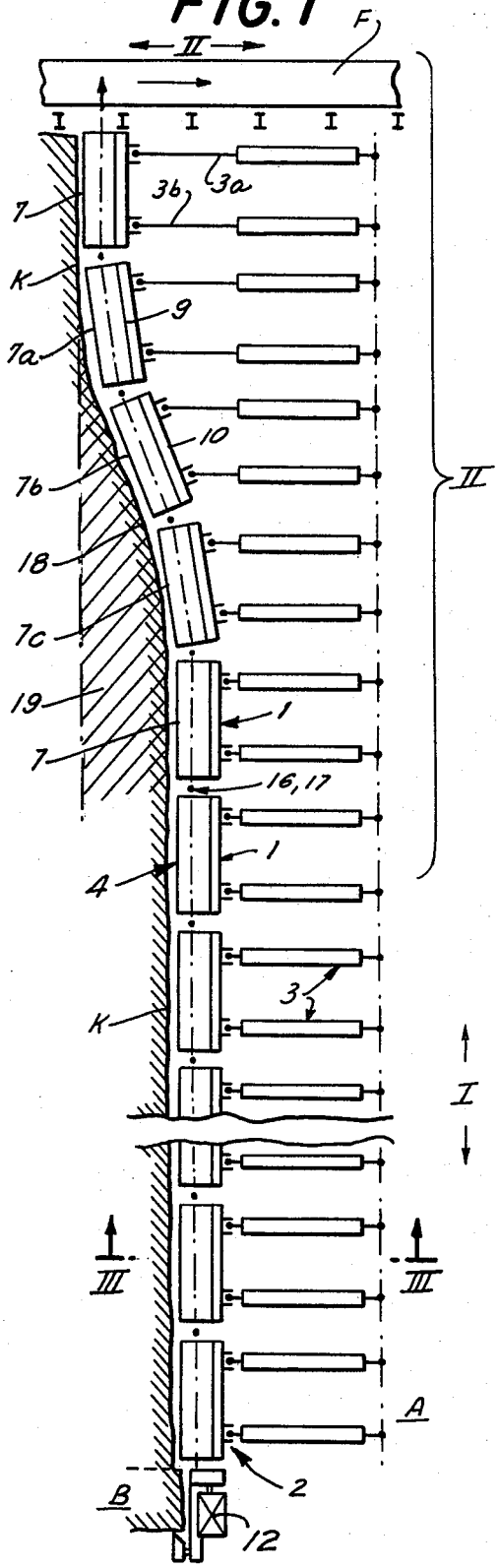
FIG. 1 is a plan view of an apparatus according to the present invention shown with respect to a cross-section through a coal body or seam.
Figure 4:
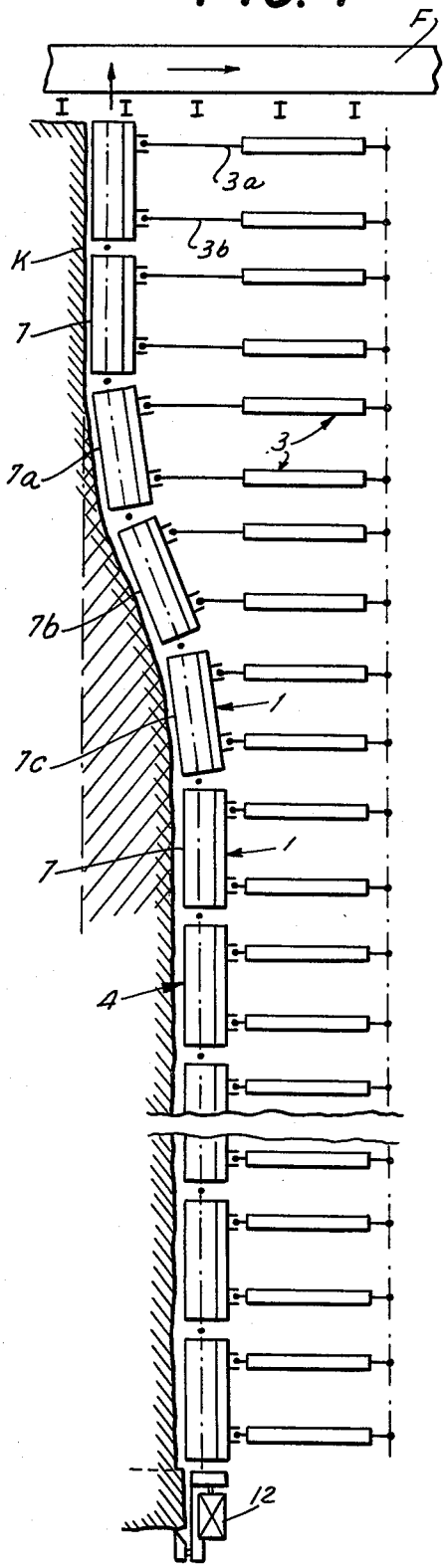
FIG. 4 shows the apparatus according to FIG. 1 in a different working position.
Figure 2:
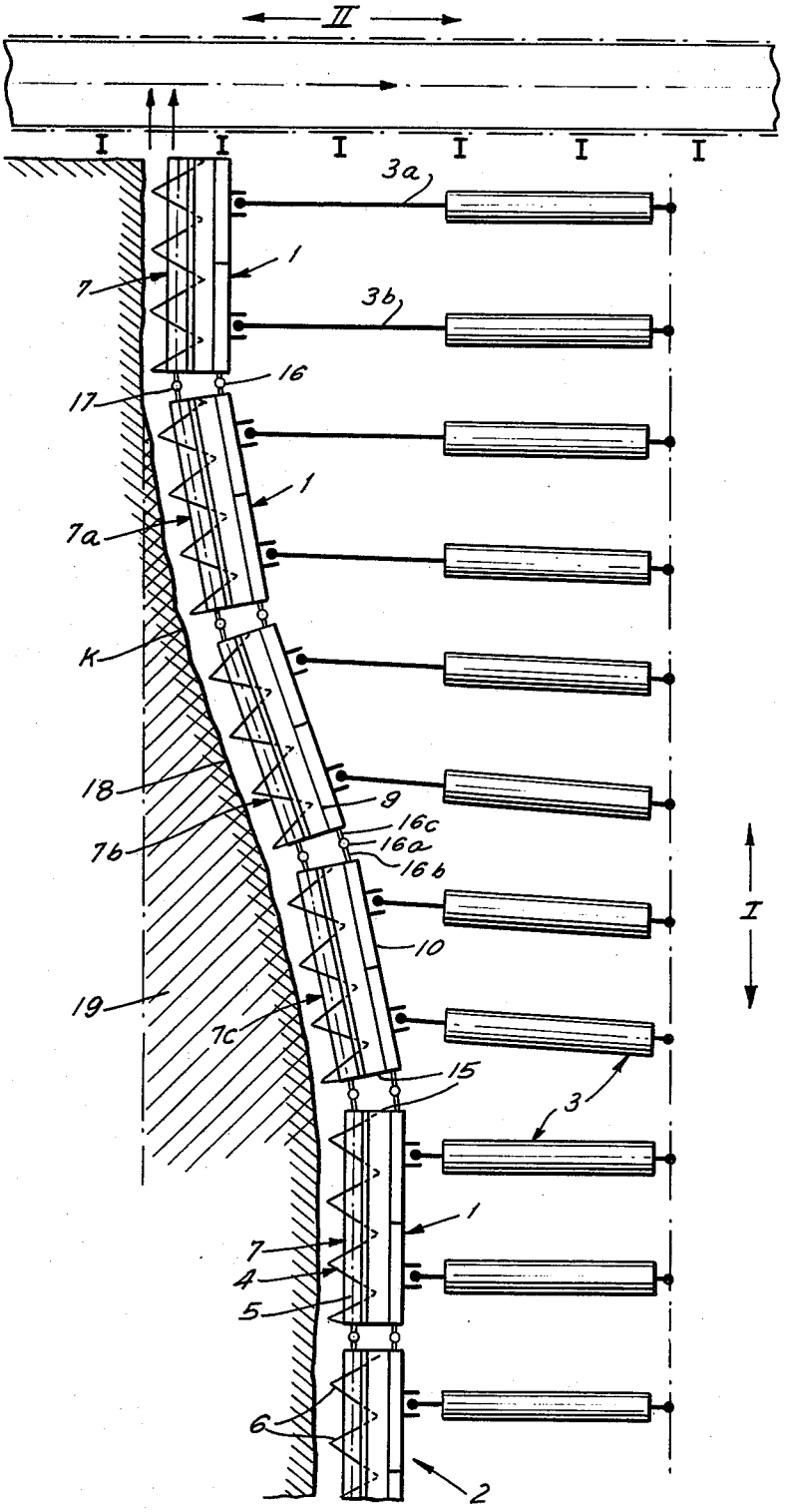
FIG. 2 is a plan view of detail II of FIG. 1 shown in a larger scale.

As shown schematically in FIGS. 1, 2 and 4 in the apparatus according to my present invention a chain of individual trough segments 1 is provided which, in series, forms a continuous conveying or transporting trough 2. In each segment 1 of trough 2 a screw, serving as conveying means, generally designated by 4, is arranged as will be further detailed below, the screw serving as recovery means for excavation of coal from a body or seam of coal designated "K."

As can best be seen by referring to FIG. 2, these conveying and recovery means are composed of a screw flight or helix 6 mounted on screw shaft 5. As will be easy to appreciate by those skilled in the art, the screw 4 may be composed of a single flight as is indicated in FIG. 2, or it may be composed of a plurality of flights. Shaft 5 is generally indicated by a dash-dot line in FIGS. 1, 2 and 4.

The screw, indicated by 4, is divided into screw segments 7 which are journaled in corresponding, individual trough sections 1 of trough 2. The screw segments 7 can be advanced by moving trough sections 1 as will be further described below.

Trough section 1 is typically composed of a bottom forming sheet metal plate 8 corresponding in length to the length of the individual trough segment 1 and a rounded segment plate 9. Segment plate 9 is formed as can be seen by referring to FIG. 3 in a semi-circle and serves as a shroud or guard against material moved by screw 4 towards the excavation designated "A."

Figure 3:
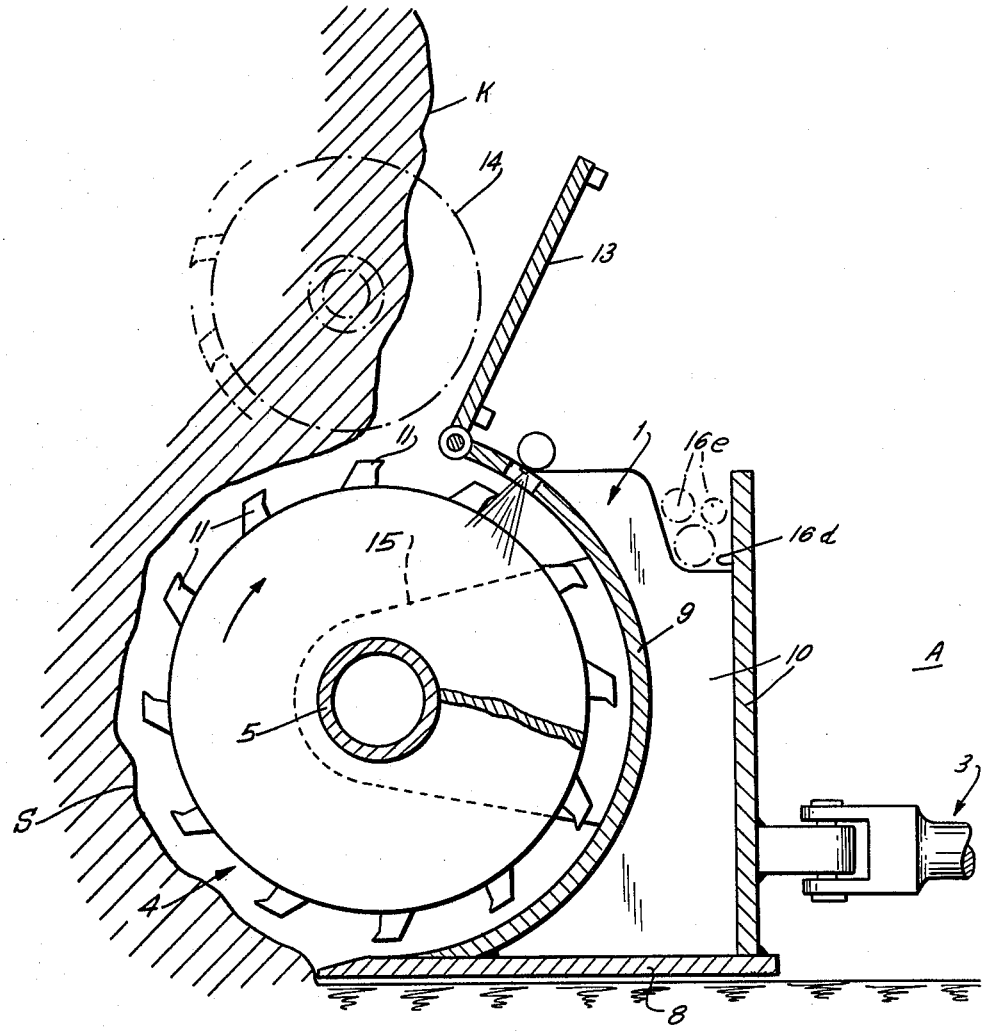
FIG. 3 is a cross-section along arrows III—III of FIG. 1.
Figure 7:
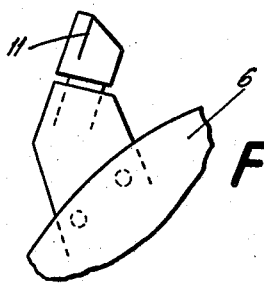
FIG. 7 shows the details of an excavating tooth in a larger scale.

Bottom forming plate 8 is joined to segment plate 9 by reinforcing plates indicated by numeral 10; thus one plate is welded in gusset-type fashion while the other plate forms a right angle with bottom plate 8, approximately abutted against the longitudinal length opposite of screw 4, as will be seen by referring to the cross-section shown in FIG. 3. The reinforcing plates serve to connect the assembly thus far described to moving means 3. Excavating tools in the form of teeth 11 are mounted on flights 6 as will be seen by referring to FIG. 7.

A drive 12 is most suitably arranged within pit "I" but, alternatively, could also be arranged in pit "II." In any event, drive 12 transmits the necessary torque to shaft 5 for the excavating and conveying of coal along trough 2 to feed conveyor F. The torque, which controls the effective mining rate, can be controlled or adjusted as will be described still further below.

Figure 5:
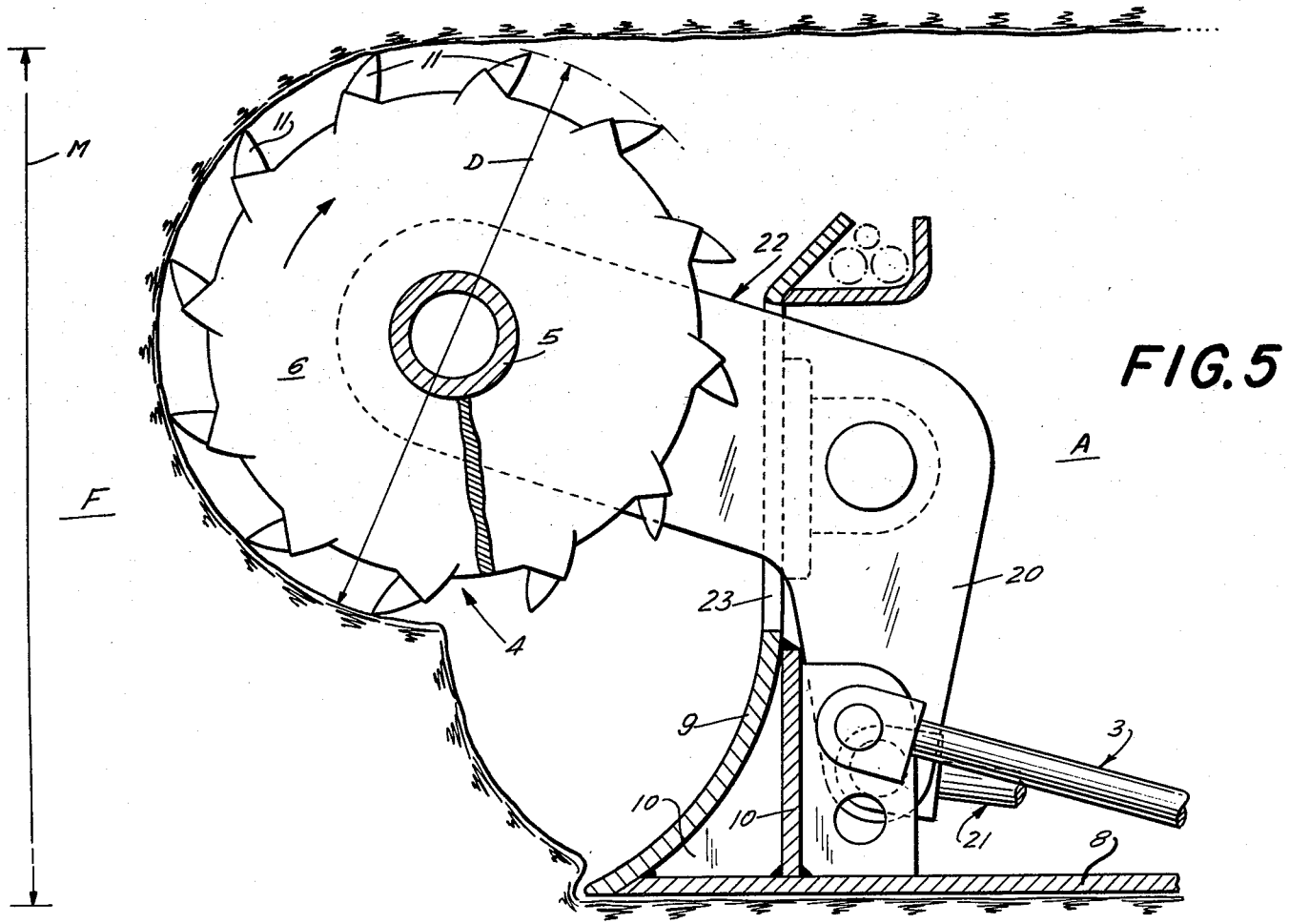
FIG. 5 shows a cross-section similar to FIG. 3 of a different embodiment of the apparatus of the present invention.
Figure 6:
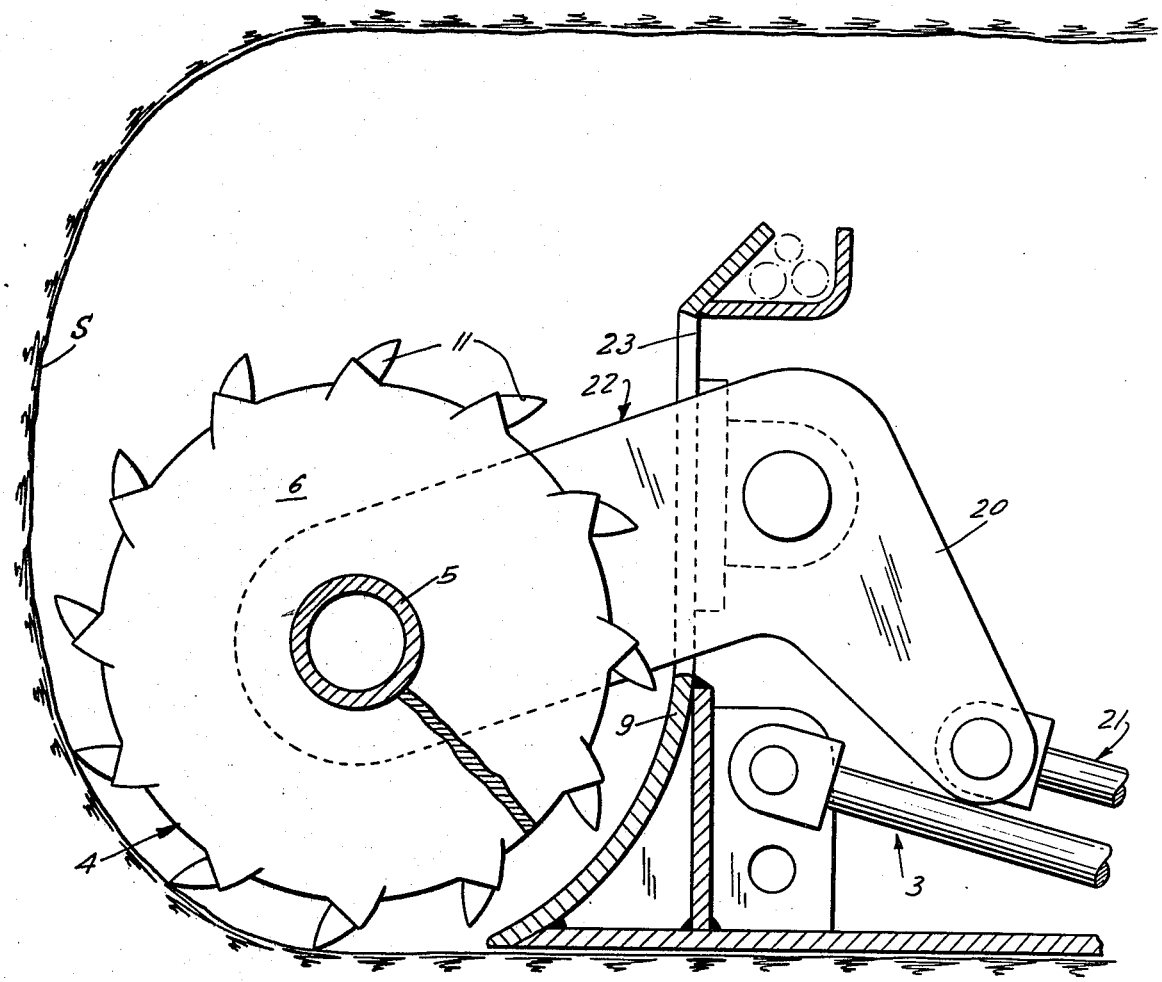
FIG. 6 shows the apparatus according to FIG. 5 in a different working position.

Excavating means 11 on flights 6 produces a concave or circular excavation "S" in coal body "K" as will be seen in FIGS. 3, 5 and 6 thereby forming a mined out area bordered by segment 9 and bottom plate 8 which mind out area is suitable for transporting therethrough the coal excavated by a screw 4 along the latter. The trough 2 is sufficiently wide to permit transport of coal not merely below the screw 4 but also to the sides thereof. Suitable brackets 15, which can be seen in FIG. 3, serve to hold in bearings, not shown, the shafts 5 of the screw sections 7 which, of course, are discontinuous and only extend over the length of a trough section 1. The trough sections or segments 1 are joined by suitable universal joints and spline couplings 16, not shown in detail. The screw sections or segments are coupled into series of suitable universal joints or couplings 17, not shown in detail, permitting longitudinal as well as other movement of the trough as a complete unit while it traverses rises or depressions in the terrain. The coupling will also permit off-setting as is evident in FIGS. 1, 2 and 4 and generally indicated by the numeral 18.

In FIG. 2, the joints 16 between the troughs 15 are shown to comprise universal couplings **16*a* and splined shafts 16*b* and 16*c* telescopingly received in the respective trough sections. The latter can be formed with channels 16*d* in which cables 16*e*** are received, the cables extending the full length of the chain of worm or screw segments.

In summary, the apparatus for the excavating and conveying of coal is comprised of trough sections carrying screw sections which sections are joined to form a continuous excavating and/or conveying apparatus. The continuous assembly is moved into position for mining or conveying as will be described in more detail below in the description of the method of my present invention.

The method of mining according to my present invention with the apparatus described in some detail above will be best appreciated by referring to FIGS. 1, 2 and 4. As is shown in FIG. 1, moving means 3 in the form of two hydraulic cylinders are attached to each section 1 by suitable articulation, not shown in detail, to permit pivoting movement between cylinder and section as well as off-setting of one end of the section with respect to adjacent.

The cylinders, typically equipped with cylinder rods, in turn, are attached to the existing support structure within the mine or an auxiliary frame support, not shown in detail and represented by a dot-dash line in FIG. 2.

As will be appreciated by referring to FIGS. 1 and 4 and also shown in a larger scale in FIG. 2, the uppermost (with respect to the top of the drawings) cylinders have extended their respective rods **3*a* a greater distance towards the body of coal thereby forming a sloping line with the body or seam of coal. The slope being indicated generally by reference to the dash-dot line representing screw shafts 6 on screw segments 7. Thus, by viewing the sequence of segments 7, 7*a*, 7*b* and 7*c*, for example, in FIGS. 1, 2 or 4, it will be seen that segment 7*a*** is about to complete its excavating function and will return to a position parallel to the face of the body of coal "K."

Segment **7*b*, in turn, is still excavating coal in a milling or cutting fashion, from the face of the wall or seam of coal while segment 7*c*** is indicated to be at the beginning of the excavating process by beginning its incline.

The actuating motion transmitted to trough sections 1 is caused, in this example, by extending the cylinder rod **3*a* which, typically, is attached to reinforcing plate 10 at the front end of a trough section while less extending the cylinder rod 3*b*, typically attached to reinforcing plate 10 at the bottom end of trough section 1. Top and bottom refer in this discussion to disposition as shown in FIGS. 1, 2 and 4** to the bottom and top of each page.

Segments 7 still further below in the sequence are all at rest, that is, they do not function in excavating position but will be rotated in an idling position by drive 12. As will be appreciated from the foregoing, the mining rate will be dictated by the relative positioning of the moving means 3, i.e. the extension of the cylinder rods or pistons with respect to the face or wall of coal to be mined, while segments that are not in excavating contact with this wall will remain in an idling or conveying state only.

In general, about three screw segments, for example **7*a*, 7*b* and 7*c*, are moved into excavating position and contribute to the effective mining operation. This mining operation is, as has been indicated earlier, carried out by excavating teeth 11 mounted on flights 6 of screw sections 4 of trough sections 1 thus removing coal from a body or seam of coal, the removal area indicated at 19 by section lines or approximately corresponding to the length of the slope. FIG. 4 shows a continuation of the mining operation represented in FIGS. 1 and 2**.

Accordingly, when moving means 3 are activating only one or a few of the segments 1, the screw-driving energy requirements will be less than when the whole chain of segments would be in excavating contact. This will be of benefit where the coal which is to be mined exhibits a different hardness along a given wall and will be of benefit in adjusting the recovery rate as well as contribute to economizing of energy requirements.

When drive 12 is arranged in pit or crosscut "I," as will be seen best in FIGS. 1 and 4, a column or pillar of coal will remain unmined so that a suitable plow-shaped or other suitable recovery means, not shown, will be provided for the removal of this column or pillar. Thus, when column B is moved by plow-shaped recovery means into the path of screws 4 it will be disintegrated or comminuted by screws 4 and then delivered by the screws toward the feed conveyor "F."

In summary, a method has been presented for the mining and conveying of coal which comprises moving screw sections or segments into excavating contact towards a body of coal so that only a few of such segments are maintained in mining or excavating position under an angle which is maintained in mining or excavating position under an angle which is maintained within the range of from 5° to 50°, which screw segments thus perform the excavating function. The remaining segments perform transporting or conveying functions only. The remaining segments 7 together with their trough segments 1 are maintained in a generally parallel position with respect to the wall or face of a body of coal. While, according to the description above, two or more segments are brought into excavating position at one time, of course, only one segment may be brought into excavating contact when couplings 17 between screw sections 4 are adjusted accordingly.

The angle of the slope may vary over the range of from 5° to 50° as will be dictated by the desired recovery rate through appropriate adjustment of moving means 3. Although this is not indicated in the drawing, the entire assembly or chain could also be moved as a unit to carry out the mining and conveying operation rather than actuating individual sections.

A modification of screw sections can be seen by referring to FIGS. 5 and 6 in which the screw sections 7, shown in cross-section, have a diameter which is, for example, about two-thirds of the thickness of the vein or seam of coal. The screw segments 7 are adjustable in height with respect to the segments 1. The screw segments 7 are journaled in the segments by means of double arms 22 which take the place of the usual bracket 15 described above which is, for example, shown in FIG. 3. Attached to the other arm of double arm 22 is an actuating rod 21 or the like which will accomplish the height adjustment of screw 4 as will be evident by comparing FIGS. 3 and 5. Thus, the forward motion of rod 21 will cause section 7 to rise thus excavating at a higher region as shown in FIG. 5. Retraction will lower section 7 as is shown in FIG. 6. According to the embodiment shown, the double arm 22 is formed as bent lever, approximately bent by 90°, which is attached, towards the excavated pit or crosscut by suitable bearings, not shown, to segment plate 9. Slots 23 permit movement of the lever arm 20 within the segment plate 9.

As a further modification an additional screw, designated 14, may be employed to recover coal from the area above that excavated by screw 4 with its respective teeth 11. This is generally shown in dot-dash lines in FIG. 3.

As is indicated by the cross-section shown in FIG. 3, the mined out area may be completely closed by providing cover plate or plates 13, hingedly fastened to segment plate 9.

I claim:

1. A method of mining coal along a wall which comprises the steps of:

disposing along said wall a chain of articulated excavating worms;

rotating said worms; and urging said worms against said wall in succession at inclinations of 5° to 50° thereto whereby the worms inclined to said wall bite into the latter and other worms along said wall displace material excavated by the inclined worms therefrom.

2. The method defined in claim 1 wherein only a single worm of said chain in an inclined position is caused to bite into said wall at a time.

3. The method defined in claim 1 wherein a plurality of worms but less than all of the worms of said chain, are caused to bite into said wall in an inclined position at any given time.

4. The method defined in claim 1 wherein said angle is 10° to 25°.

5. The method defined in claim 1, further comprising the step of vertically displacing the inclined worm.

6. An apparatus for the mining of coal along a wall, said apparatus comprising:

a plurality of articulated excavating segments in end-to-end relation defining a chain adapted to be disposed along said wall, each of said segments comprising a trough-forming housing and a respective excavating worm rotatably mounted in said housing, said worms being interconnected for joint rotation;

means for driving said worms to displace excavated material along said troughs;

a support; and respective members between said support and each of said segments for individually displacing said segments in inclined relation to said wall to cause the respective worm to bite into said wall and excavate material therefrom while other segments lie parallel to said wall and serve only for displacement of the excavated material, said members being so constructed and arranged as to cause a worm biting into said wall to engage the latter at an angle of substantially 5° to 50°, each of said troughs comprising a bottom plate articulated to at least one of said members and riding along the ground, a curved plate connected to said bottom plate and rising therefrom, a lever projecting forwardly from the trough for rotatably mounting the respective worm thereon, and mechanism engaging said lever for displacing the respective worm transversely to its axis.

7. The apparatus defined in claim 6 wherein each of said worms is connected to an adjacent worm by a respective universal joint, the troughs of adjacent segments being interconnected by a spline coupling, said troughs being relatively longitudinally displaceable.

8. The apparatus defined in claim 6 wherein said worms have helical flights formed with respective cutting teeth.

9. In a worm-type excavator wherein a trough-forming member is urged against a wall to be excavated and an excavating worm is journaled in said trough-forming member for excavation of said wall upon rotation of said worm, the improvement wherein said member comprises at least one double-arm lever fulcrumed on said trough-forming member between its arms and rotatably carrying said worm on one of said arms, and mechanism engaging the other arm of said double-arm lever for swinging the same to shift said worm transversely to its axis.

* * * * *